United States Patent [19]

Takeuchi et al.

[11] Patent Number: 4,787,867

[45] Date of Patent: Nov. 29, 1988

[54] TRIM TAB ACTUATOR FOR MARINE PROPULSION DEVICE

[75] Inventors: Toshio Takeuchi; Shinya Atsumi, both of Hamamatsu, Japan

[73] Assignee: Sanshin Kogyo Kabushiki Kaisha, Hamamatsu, Japan

[21] Appl. No.: 52,712

[22] Filed: May 20, 1987

[30] Foreign Application Priority Data

May 23, 1986 [JP] Japan ..... 61-117467

[51] Int. Cl.[4] ..... B63H 21/26

[52] U.S. Cl. ..... 440/1; 440/51; 440/53

[58] Field of Search ..... 440/1, 51, 53; 114/144 E, 275–277, 285–287, 167, 144 C; 244/195; 364/400

[56] References Cited

U.S. PATENT DOCUMENTS 3,972,301 8/1976 Protta ..... 114/144 C
4,318,701 3/1982 Kirkwood et al. ..... 440/51
4,615,290 10/1986 Hall ..... 440/51

FOREIGN PATENT DOCUMENTS 56-160297 12/1981 Japan .
94898 5/1985 Japan ..... 114/144 E

*Primary Examiner*—Sherman D. Basinger
*Attorney, Agent, or Firm*—Ernest A. Beutler

[57] ABSTRACT

An improved trim tab actuator for an outboard drive for assisting in steering by creating a hydrodynamic steering force immediately upon sensing of a steering input force. The mechanism includes an operator control that permits the operator to select from any of a plurality of preset maps for achieving the optimum trim tab condition.

16 Claims, 2 Drawing Sheets

TRIM TAB ACTUATOR FOR MARINE PROPULSION DEVICE

BACKGROUND OF THE INVENTION

This invention relates to a trim tab actuator for a marine propulsion device and more particularly to an automatic trim tab actuator that may be selectively controlled by the operator so as to provide any of a plurality of selected degrees of automatic control.

It is known in connection with marine outboard drives to employ a trim tab that is supported on the outboard drive and which is pivoted in an opposite direction to the steering direction of the outboard drive so as to create a hydrodynamic force that assists in the steering movement. Although such devices have the advantage of providing assist for steering, they have certain disadvantages. The types of devices proposed for this purpose previously are activated by means of a lost motion connection between the steering device of the outboard drive and the outboard drive. That is, the trim tab is activated in response to a predetermined degree of lost motion between the steering input and the actual steering of the outboard drive. As a result this creates a lag in the activation of the trim tab and further necessitates the incorporation of a lost motion mechanism between the steering and the outboard drive. The use of such a lost motion connection has the disadvantage of permitting the outboard drive to move relative to the steering device and thus the outboard drive may be steered by external forces such as waves or the like which will, of course, cause course deviations.

In addition to the aforenoted disadvantages, the previously proposed trim tab activating systems have permitted only a fixed ratio of trim tab position change with respect to changes in position of the outboard drive or the steering input to the outboard drive. However, the optimum trim tab position for a given input may vary with a wide variety of watercraft conditions.

It is, therefore, a principal object of this invention to provide a trim tab actuator for a marine propulsion device that is operative instantaneously upon the application of a steering input.

It is a further object of this invention to provide a trim tab activator that does not require lost motion in the steering of the outboard drive.

It is a further object of this invention to provide a trim tab activator for an outboard drive that can be selectively tuned to a variety of running conditions.

It is yet another object of this invention to provide an operator controllable trim tab activator that permits any of a wide variety of automatic operations to be employed for the trim tab.

BRIEF SUMMARY OF THE INVENTION

A first feature of this invention is adapted to be embodied in a marine outboard drive that is mounted for steering movement about a generally vertically extending steering axis. A trim tab is supported for movement relative to the outboard drive from a neutral position to positions for generating a hydrodynamic force for assisting in the steering movement of the outboard drive. A steering member is adapted to be activated by an operator for steering the outboard drive. Force sensing means are provided for detecting the occurrence of an operator induced steering force and means are employed for moving the trim tab immediately in response to the detection of an operator steering input from the force sensing means.

Another feature of this invention is adapted to be embodied in a watercraft having a trim tab that is movably supported between a neutral position and any of a plurality of positions for creating a steering effect. Means are provided for activating the trim tab between its positions. Means are also incorporated for sensing a watercraft condition that effects the optimum position of the trim tab. Computer means contain a plurality of premapped positions for the trim tab in response to the sensed watercraft condition. Means are also incorporated for moving the trim tab in response to a signal from the computer means. Operator controlled means selectively determine which of the computer maps is effective to control the trim tab.

DETAILED DESCRIPTION OF THE PREFERRED EMBODIMENT

Figure 1:
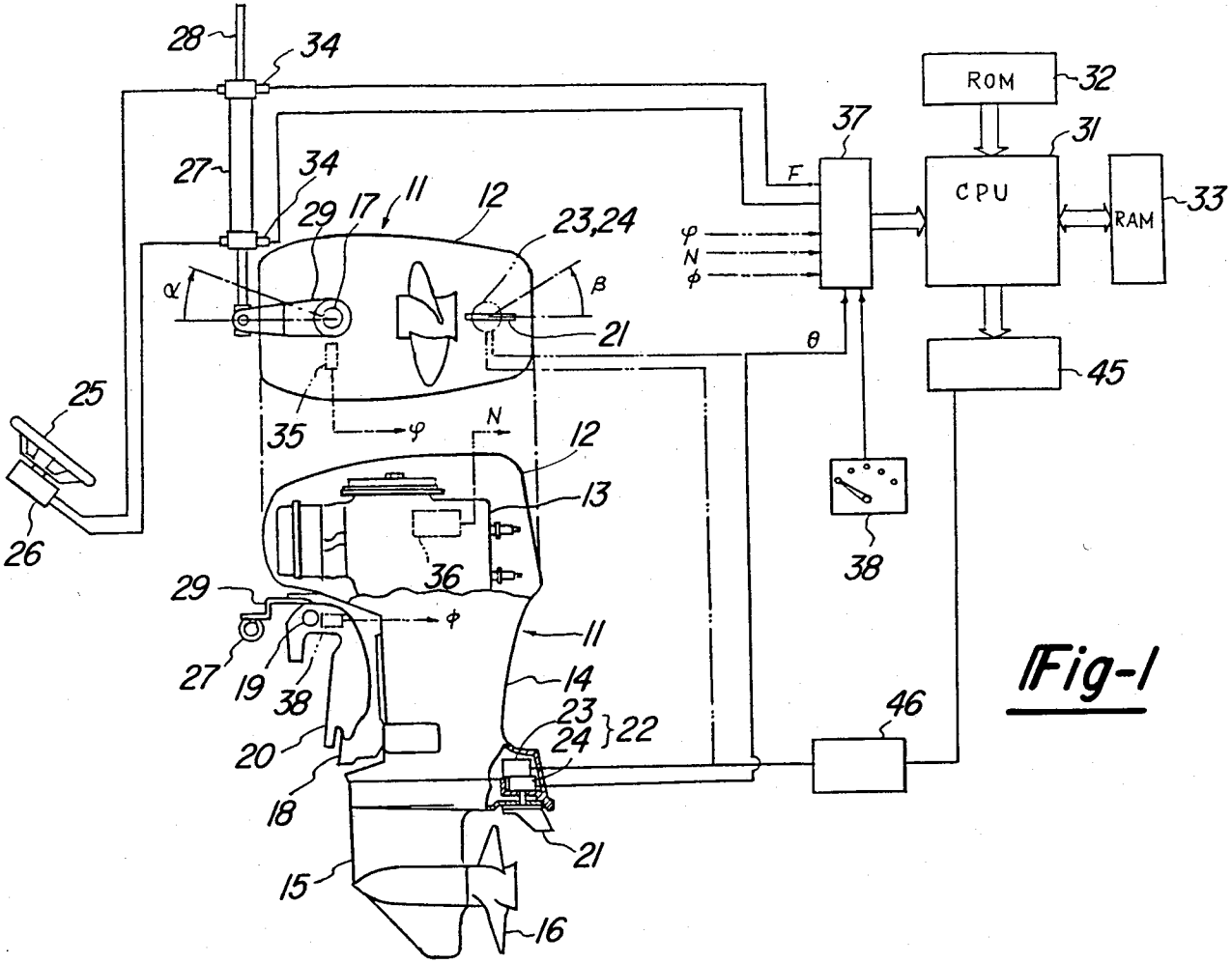
FIG. 1 is a side elevational view, with portions broken away and other portions shown schematically, and partial top plan view of a marine propulsion device embodying a trim tab actuator constructed in accordance with an embodiment of the invention.

Referring first to FIG. 1, an outboard motor constructed in accordance with an embodiment of the invention is identified generally by the reference numeral 11. Although the invention is described in conjunction with an outboard motor, it is to be understood that it may be employed with any form of outboard drive including the outboard drive of an inboard-outboard drive.

The outboard motor 11 includes a power head assembly, indicated generally by the reference numeral 12, and including an internal combustion engine 13, which may be of any known type. The engine 13 drives a drive shaft (not shown) that is journaled within a drive shaft housing 14 that depends from the power head 12. The drive shaft terminates within a lower unit 15 that is positioned at the lower end of the drive shaft housing 14 and drives a propulsion device in the form of a propeller 16 through a suitable forward, neutral, reverse transmission (not shown) which may be of any known type.

In accordance with standard outboard motor practice, the drive shaft housing 14 has affixed to it a steering shaft 17 that is journaled for steering movement about a generally vertically extending axis within a swivel bracket 18. The swivel bracket 18 is, in turn, pivotally connected by means of a pivot pin 19 to a clamping bracket 20. The pivotal connection afforded by the pivot pin 19 permits the outboard motor 11 to be tilted up or swung through a plurality of trim adjusted positions, as is well known in this art. The clamping bracket 20 affords an arrangement for detachably connecting the outboard motor 11 to the transom (not shown) of an associated watercraft. The construction of the outboard motor 11 as thus far described and its connection to the watercraft may be considered to be conventional. For that reason, further details of this construction are not believed to be necessary to understand and practice the invention.

In accordance with the invention, a trim tab, indicated generally by the reference numeral 21, is pivotally supported about an axis that extends parallel to the steering axis by means of the drive shaft housing 14 and in proximity to the lower unit 15 and propeller 16. The trim tab 21 is disposed so that it will be submerged in the water and will generate a hydrodynamic force for creating steering forces upon the outboard motor 11.

In accordance with the invention, an actuator device, indicated generally by the reference numeral 22 and including a reversible electric motor 23 and gear reduction unit 24, is coupled to the trim tab 21 for rotating it. The reversible electric motor 23 is controlled by means of a control system, to be described, so as to create the desired hydrodynamic forces to aid in steering movement of the outboard motor 11.

The steering mechanism for the outboard motor 11 includes, in addition to the steering shaft 17 and swivel bracket 18, a remotely positioned steering wheel 25. The steering wheel 25 operates a manually operated fluid pump 26 that supplies fluid through a pair of control lines to a hydraulic motor 27 that is mounted in a fixed position relative to the outboard motor 11 adjacent the transom of the associated watercraft. The fluid motor 27 has an internal piston (not shown) which divides the fluid motor 27 into a pair of chambers and which piston is connected to a piston rod 28. The piston rod 28, in turn, has a pivotal connection to one end of a steering arm 29. The steering arm 29 is affixed to the steering shaft 20 and is effective to cause pivotal movement of the outboard motor about the swivel bracket 18.

The trim tab 21 is activated, in a manner to be described, so as to provide the optimum steering assist dependent upon the operator's selection and a variety of factors including the condition of the steering input, the actual steered angle to the outboard motor 11 and a variety of variable factors associated with the operation of the outboard motor 11 and the watercraft. Among these additional factors are speed of travel and trim anlge. These conditions are, in accordance with the invention, sensed by any of a plurality of sensors and this information is fed to a central processing unit (CPU) indicated schematically at 31 which CPU also includes a ROM 32 and a RAM 33 and processes these signals and compares with preset values and then control the actuating device 22 so as to set the trim tab 21 in the appropriate position to obtain optimum steering for the watercraft conditions and those selected by the operator.

Realizing the invention, it is believed to be within the scope of those skilled in the art to determine which of these factors will be employed to achieve the control of the trim tab 21 and how, in fact, they are sensed. It should be understood that with certain watercraft, certain, of these factors may be insignificant and others more important.

In the illustrated embodiment, the steering input force is measured by means of a pair of pressure sensors 34 that are positioned in the chambers at the opposite ends of the fluid motor 27. These devices are pressure devices which indicate a pressure which is equivalent to force input by the operator. It is to be understood, however, that force can be measured in any other manner such as by means of a strain gauge. Also, in cable operated steering mechanisms, the steering force can be measured by a strain gauge to sense the tension in the cable or any other known manner for so measuring forces.

The angle of steered condition of the input to the steering mechanism $\alpha$ is measured by a sensor 35 which outputs an angular steering position signal indicated at $\Psi$.

Other conditions such as watercraft speed is sensed by an engine speed sensor, indicated schematically at 36, which may comprise the pulser coil of the ignition system of the engine 13. This engine speed sensor outputs an engine speed signal N which, with the other sensed condition signals, is delivered to an input interface 37 which converts the signal into an appropriate signal for processing by the CPU 31. Alternatively to sensing engine speed, the watercraft speed may be sensed in any of a variety of fashions, such as by utilizing an actual water speed sensor (ideally a velocity sensor in proximity to the propeller 16) or in any known manner.

In accordance with the illustrated embodiment, the trim angle of the watercraft is also sensed by means of a trim condition sensor 38 that is carried by the swivel bracket 18 and which outputs a trim angle signal $\phi$ to the interface 37 for conversion into an appropriate signal for transmission to the CPU 31. In the illustrated embodiment, trim angle and watercraft velocity are the only watercraft conditions which are sensed and processed by the CPU 31. As aforenoted, however, a wide variety of other watercraft conditions may be sensed and processed by the CPU 31.

The gear reduction unit 24 also includes an angle position sensor for sensing the angular position $\beta$ of the trim tab 21. This sensor outputs of a signal $\theta$ to the interface 37 for conversion into an appropriate signal for processing by the CPU 31.

In addition to the sensing units that provide signals for sensing the various watercraft conditions and the conditions of the steering of the outboard drive 11, there is provided an operator selector switch 38 which permits the operator to select one of a plurality of premapped trim tab positions for the sensed conditions. These premapped conditions may be maximum steering assist, moderate steering assist, low steering assist or any of a wide variety of trim tab conditions that will affect the steering and performance of the outboard drive 11. Also, the premapped conditions may be chosen so as to suit the type of sea conditions such as rough sea, mild sea, etc. A wide variety of maps will present themselves to those skilled in the art and these selected map signals are then transmitted to the CPU 31 via the interface 37 so that the operator can make his selection.

The CPU 31 and its RAM 33 and ROM 32 are preprogrammed so as to compare the steering input forces F, the steered angle $\Psi$ sensed speed N and trim angle condition $\phi$ and to generate an output signal generated by the selected one of the series of maps and indicative of the desired trim tab position for these sensed conditions and the selected map chosen by the operator's selection by switch 38. The CPU 31 also receives the signal indicating the trim tab position $\theta$ and makes an internal comparison to determine if the trim tab angle that is existent is the desired angle or not. This processing may be best unerstood by reference to FIG. 2, which is a block diagram showing the logic of the CPU 31.

Figure 2:
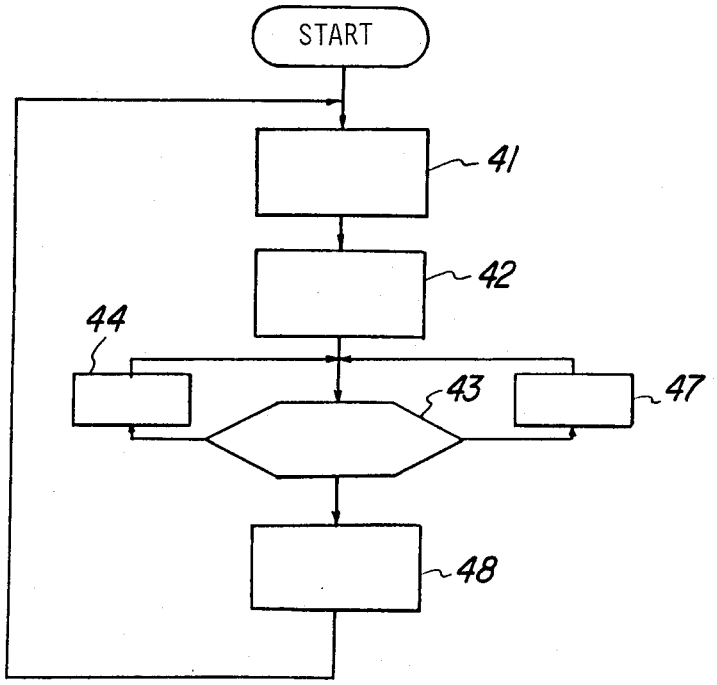
FIG. 2 is a block diagram showing the logic of the CPU in setting the trim tab device in accordance with an embodiment of the invention.

In FIG. 2, at the initialization or starting step, which is initiated when the main switch (not shown) is switched on, the CPU 31 performs an initialization step and then reads the input signals of steering input force F, steering angle $\Psi$, engine speed N, trim angle $\phi$ and trim tab angle $\theta$ sequentially through the interface 37 at the step 41. These signals are then stored temporarily in the RAM 27 at this same step 41.

From the input signals of steering input force, steering angle, speed, trim position, and trim tab position (F, $\Psi$, N, $\phi$ and $\theta$), and also the operator's selection of the chosen map by the switch 38, the CPU outputs a signal (H) at the block 42 which comes from the selected map memorized in the ROM 32.

After the output signal (H) is generated, the CPU compares that signal with the actual trim tab angle position $\theta$ at the step 43. If clockwise adjustment is necessary, the system moves to the block 44 so as to active the motor 23 in the appropriate direction through an output interface 45 (FIG. 1) and driver 46 so as to achieve rotation in this direction. On the other hand, if counterclockwise rotation is determined, the system moves to the block 47 and achieves this rotation. The rotation continues cyclically until the comparison indicates that the actual trim tab angle $\theta$ is equal to the desired trim tab angle (H) and then the program is stopped at the step 48.

It should be noted that, in addition to providing the initial setting for the trim tab 21 to achieve maximum steering assist, the device can operate so as to reduce the trim tab angle in the event the steering force becomes less than a predetermined value during the steering motion. In such an arrangement, the actuator 22 should be provided with a variable resistor for presetting such values as the pivotal angle setting means and also a comparator for comparing the predetermined value and the detected actual steering force. Of course, the foregoing description is only that of a preferred embodiment of the invention and various other changes and modifications may be made without departing from the spirit and scope of the invention, as defined by the appended claims.

We claim:

1. In a marine outboard drive mounted for steering movement about a generally vertically extending steering axis, a trim tab supported for movement relative to said outboard drive from a neutral position to a position for generating a hydrodynamic force for assisting in the steering movement of said outboard drive, a steering member adapted to be activated by an operator for steering said outboard drive by applying a force to said outboard drive directly from said steering member, force sensing means for detecting the occurrence of an operator induced steering force, power operated means for moving said trim tab immediately in response to the detection of an operator's steering input from said force sensing means including a plurality of preprogrammed maps for achieving the desired trim tab angle, and operator controlled means for selecting the map which controls said trim tab angle.

2. In a marine outboard drive as set forth in claim 1 wherein the trim tab is pivotally supported.

3. In a marine outboard drive as set forth in claim 2 wherein the trim tab is pivoted in a direction opposite to that which the outboard drive is steered for assisting in the steering.

4. In a marine outboard drive as set forth in claim 1 wherein the optimum trim tab angle is set by means of sensing a plurality of conditions in addition to the steering input force.

5. In a marine outboard drive as set forth in claim 4 wherein the conditions include a watercraft condition.

6. In a marine outboard drive as set forth in claim 5 wherein the watercraft condition is speed.

7. In a marine outboard drive as set forth in claim 5 wherein the watercraft condition is trim.

8. In a watercraft, a trim tab movably supported by said watercraft from a neutral condition to any of a plurality of positions for creating a steering effect, means for activating said trim tab between said positions, means for sensing a watercraft condition that effects the optimum position of said trim tab, computer means containing a plurality of maps of desired positions for said trim tab in response to the sensed watercraft conditions, means for moving said trim tab in response to a signal from said computer means, and operator control means for selecting which of said computer maps is effective to control said trim tab.

9. In a watercraft as set forth in claim 8 wherein the sensed watercraft condition includes steering of the watercraft.

10. In a watercraft as set forth in claim 9 wherein the watercraft steered condition is sensed by sensing the angle of an outboard drive.

11. In a watercraft as set forth in claim 10 wherein the steered condition is sensed by sensing the force applied to the watercraft steering system.

12. In a watercraft as set forth in claim 8 wherein the sensed watercraft conditions include trim angle.

13. In a watercraft as set forth in claim 8 wherein the sensed watercraft conditions include speed.

14. In a watercraft as set forth in claim 8 wherein there are a plurality of sensed watercraft conditions.

15. In a marine outboard drive as set forth in claim 1 wherein the power operated means is electrically controlled.

16. In a marine outboard drive as set forth in claim 15 wherein the power operated means comprises an electrically operated motor.

* * * * *